US005334044A

United States Patent [19]

Falossi et al.

[11] Patent Number: 5,334,044

[45] Date of Patent: Aug. 2, 1994

[54] RADIO JACK STRAIN RELIEF AND IDENTIFICATION HOLDER

[76] Inventors: Aldo Falossi, 22496 Caminito Grande, Laguna Hills, Calif. 92653; Paul Thomas, 1257 W. O'Farrell St., San Pedro, Calif. 90731

[21] Appl. No.: 67,586

[22] Filed: May 27, 1993

[51] Int. Cl.[5] ..... H01R 13/50

[52] U.S. Cl. ..... 439/491; 439/447; 439/676

[58] Field of Search ..... 439/447, 488, 491, 676; 29/862

[56] References Cited

U.S. PATENT DOCUMENTS

| | | | |
|---|---|---|---|
| 3,792,415 | 2/1974 | Fuller | 439/447 X |
| 4,070,548 | 1/1978 | Kasper | 439/676 X |
| 4,220,387 | 9/1980 | Biche et al. | 439/491 X |
| 4,840,582 | 6/1989 | Marson | 439/491 |
| 5,090,916 | 2/1992 | Magnier | 493/676 X |

FOREIGN PATENT DOCUMENTS

| | | | |
|---|---|---|---|
| 0419766 | 4/1991 | European Pat. Off. | 439/676 |

*Primary Examiner*—Eugene F. Desmond

*Attorney, Agent, or Firm*—Thomas I. Rozsa; Tony D. Chen

[57] ABSTRACT

The present invention is a radio jack strain relief and identification holder. The strain relief and identification holder is used to provide strain relief and identification to the radio jack. It includes a flexible holder comprising an entrance for receiving a radio jack and an opposite cable entrance with reduced inner cross-sectional dimensions for tightly retaining a cable such that the reduced inner cross-sectional dimensions engage against opposite sides of the cable for relieving any strain transmitted on the cable. It also includes a C-shaped ring with identifying indicia thereon so that the radio jack and cable can be identified.

29 Claims, 5 Drawing Sheets

RADIO JACK STRAIN RELIEF AND IDENTIFICATION HOLDER

BACKGROUND OF THE INVENTION

1. Field of The Invention

The present invention relates to the field of telecommunication and data communication industries. In particular, the present invention relates to a radio jack strain relief and identification holder utilized in the telecommunication and data communication industries.

2. Description of The Prior Art

The concept of strain relief for relieving any strain that otherwise might be transmitted to the joint between the cable wires and the multiple wire connector is old in the art. While strain relief is provided in electronic connectors, the telecommunication and data communication industries do not provide any strain relief on the radio jacks. One example of this type of strain relief can be found in one's house which has telephone connections. The telephone connections typically comprise a male-type radio jack attached to the complementary mating female-type radio jack outlet. This type of telephone cable and radio jack does not have any strain relief or any identification markings.

The growth of the telephone networks over time has resulted in extensive, complex and variable interface and interconnect wiring installations. This has made cable identifying and troubleshooting a more difficult and time consuming task during system installation and also during system repair. Therefore, there is an increased need for an apparatus and a method which simplifies the means for identification of cable wires, and also provides strain relief. The strain relief provides a method of preventing the detachment of one or more of the cable wires from the radio jack during use. It is also desirable to provide a strain relief for engaging the overall cable, and thereby relieving any strain that otherwise might be transmitted to the joint between the cable wires and the radio jack. In addition, a strain relief should be made of semi-soft material in order to provide significant relief.

SUMMARY OF THE INVENTION

The present invention is a radio jack strain relief and identification holder. The novelty of the present invention is that it does not put strain on the cable wires, but in fact is spread over the extended length of the cable. The strain relief and identification holder has an elongated flexible body comprising a cable entrance with reduced inner cross-sectional dimensions. The primary object of the present invention is to provide strain relief and identification to the radio jack.

The present invention is a novel and unique strain relief and identification holder particularly designed for radio jacks.

It has been discovered, according to the present invention, that in many situations such as in telecommunication and data communication applications, it is highly desirable to employ a combination holder with an identification system that is capable of tightly retaining and identifying a radio jack, and which will also relieve any strain that otherwise might be transmitted to the joint between the cable wires.

It has further been discovered, according to the present invention, that by having reduced inner cross-sectional dimensions in the strain relief and identification holder, it will provide a way for accommodating different cable diameters such that the reduced inner cross-sectional dimensions of the strain relief and identification holder engage against opposite sides of the cable for relieving any strain transmitted on the cable, and the strain is spread over the extended length of the cable.

It is therefore an object of the present invention to provide an apparatus and method of retaining and identifying a radio jack.

In the preferred embodiment of the present invention, the radio jack strain relief and identification holder comprises a conventional male-type radio jack and a strain relief. The conventional male-type radio jack is partially enclosed at the front end of the strain relief and identification holder, while the rear end comprises a cable entrance with reduced inner cross-sectional dimensions for accommodating different cable diameters and shapes. The strain relief and identification holder further comprises a C-shaped ring with stenciled identification for identifying the radio jack.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

FIG. I is a perspective view of the present invention radio jack strain relief and identification holder connected to a flat cable.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Described briefly, the present invention is a radio jack strain relief and identification holder. The essential parts of the present invention include a conventional male-type radio jack connected to cable wires, and a strain relief and identification holder with a C-shaped ring attached thereto for identifying the radio jack.

Figure 1:
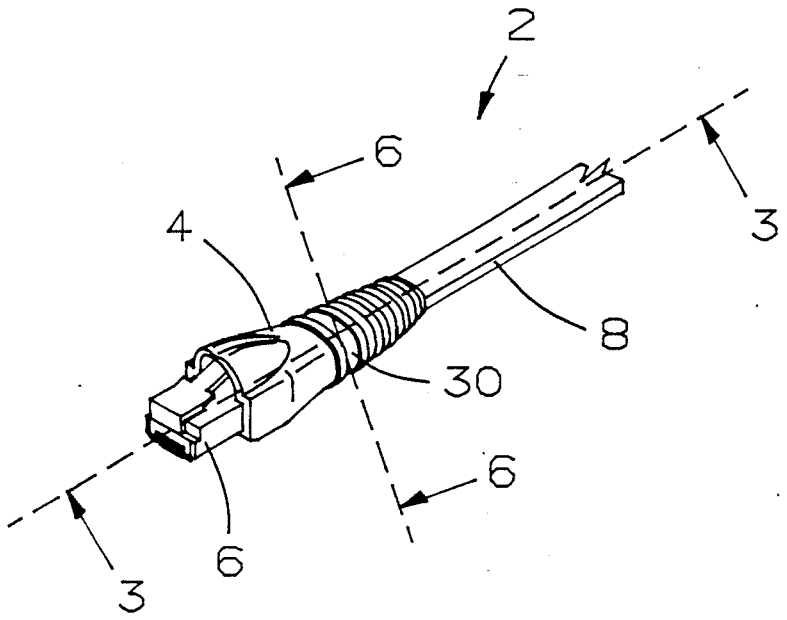

Referring to FIG. 1, there is shown at 2 a perspective view of a radio jack strain relief and identification holder 4 used in conjunction with a conventional radio jack 6, and a flat cable 8.

Figure 2:
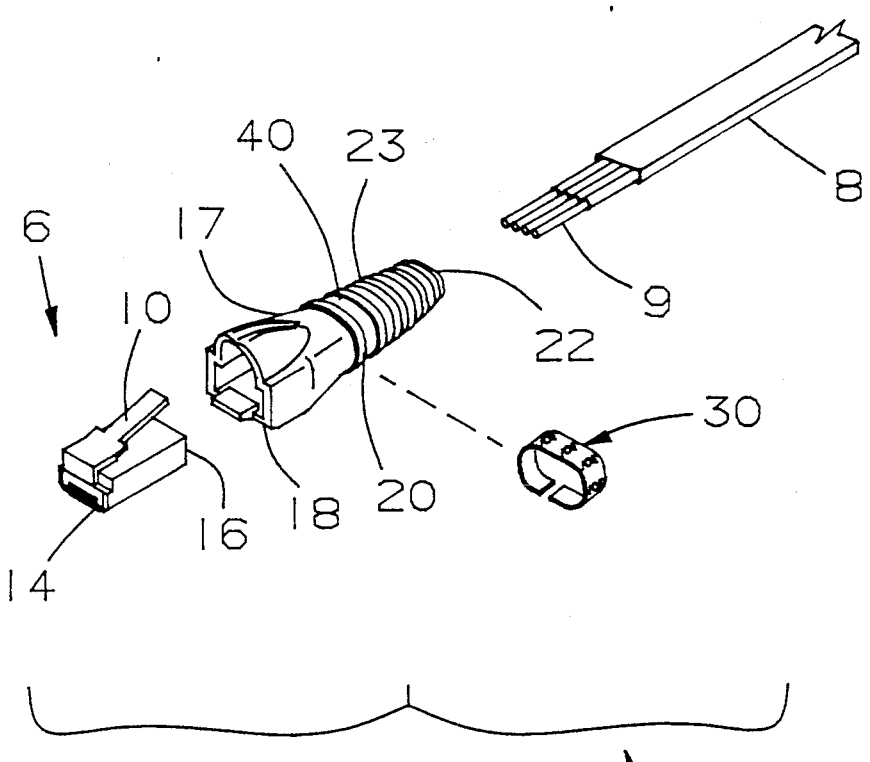
FIG. 2 is an exploded view of the present invention radio jack strain relief and identification holder shown in FIG. 1.
Figure 3:
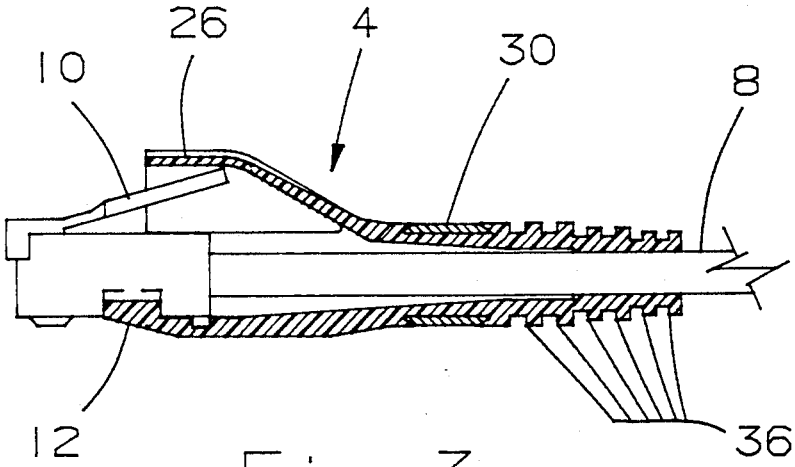
FIG. 3 is an enlarged cross-sectional view of the present invention radio jack strain relief and identification holder taken along line 3—3 of FIG. 1.

Referring to FIGS. 2 and 3, there is shown at 2 an exploded view of the present invention radio jack strain relief and identification holder 4. The conventional radio jack 6 is generally rectangular shaped comprising a front end 14, a rear end 16, a top index lock pin or release lever 10 and an opposite bottom recess notch 12. The radio jack 6 is preferably assembled with four cable wires 9, as illustrated in FIG. 2, but can be assembled with any multiplicity of cable wires depending on the application. The commonalty of the present invention is the holding method which is the same for 2, 4, 6 or 8 conductors regardless of the radio jack 6.

Figure 4:
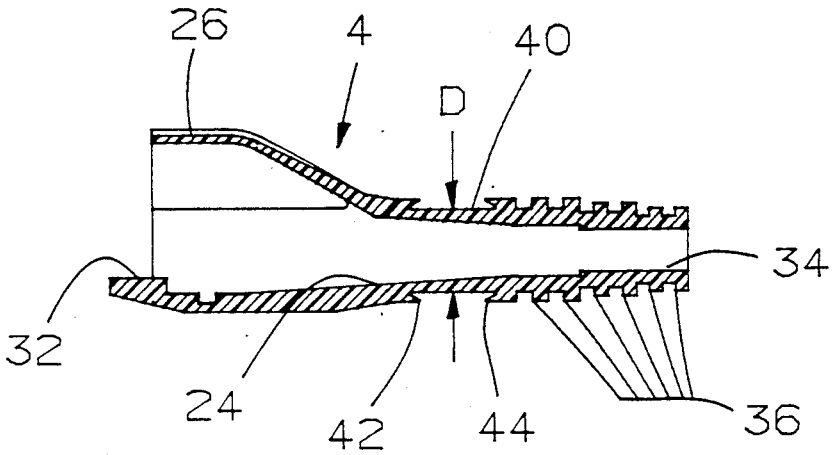
FIG. 4 is an enlarged cross-sectional view of the present invention radio jack strain relief and identification holder without the radio jack and cable.
Figure 5:
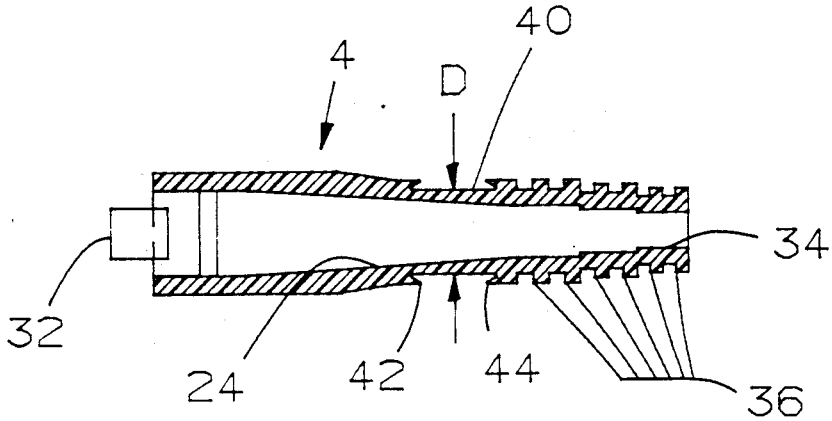
FIG. 5 is an enlarged top cross-sectional view of the present invention radio jack strain relief and identification holder without the radio jack and cable.

Referring to FIGS. 2, 3 and 4, there is shown in FIGS. 3 and 4 an enlarged cross-sectional view of the present invention. The strain relief and identification holder 4 has an elongated flexible body 17 with a front end 18, a middle section 20 and a rear section 23 with a rear end 22. The strain relief and identification holder 4 comprises a hollow interior chamber 24 which extends from a wide opening at the front end 18 to a narrow opening at the rear end 22. The narrow opening at the rear end 22 of the strain relief and identification holder 4 forms a longitudinal internal cable entrance with reduced inner cross-sectional dimensions 34, which provide a way for accommodating different cable diameters and shapes such that the reduced inner cross-sectional dimensions 34 of the strain relief and identification holder 4 engage against opposite sides of cable 8 for relieving any strain transmitted on cable 8. The novelty of the strain relief and identification holder 4 is that it does not put strain on the cable wires 9, but in fact the strain is spread over the extended length of the cable 8. The rear section 23 of the strain relief and identification holder 4 has a multiplicity of lateral rings 36. Each lateral ring 36 increases in diameter from a narrow diameter at the rear end 22 to a wider diameter at the middle 20 of this rear section, as illustrated in FIG. 5. This feature makes cutting off the excess elongated flexible body 17 of the strain relief and identification holder 4 a simple task for accommodating different cable diameters and shapes.

A protruding tongue 32 extends outwardly and upwardly from the lower interior surface of the wide opening of the front end 18 of the strain relief and identification holder 4 at a location opposite to a flexible dust cover 26. The protruding tongue 32 is utilized for engaging with the bottom recess notch 12 of the radio jack 6, and preventing the radio jack 6 from longitudinal movement within the wide opening of the strain relief and identification holder 4. The flexible dust cover 26 is integrally molded to the holder 4 at a location adjacent to the front end 18 for partially covering the top index lock pin or release lever 10 of the radio jack 6. The index lock pin 10 can be released or connected by pressing the flexible dust cover 26 onto the index lock pin 10, thereby connecting or releasing the radio jack 6 from the complementary mating outlet.

The strain relief and identification holder 4 can be made from several materials. The manufacturing process which could accommodate the construction of the strain relief and identification holder 4 may be injection, thermoform, etc. or other molding process. By way of example, the elongated flexible body 17 of the strain relief and identification holder 4 is preferably constructed of semi-rubber material or elastomer material, and therefore, it can accommodate round and rectangular cables. However, the strain relief and identification holder 4 can be made of any suitable semi-soft material in order to provide significant strain relief. By being made of semi-rubber or other elastic material, the strain relief can stretch to fit round and rectangular cables. The molding and mass production process would enable the strain relief and identification holder 4 to be produced inexpensively. The present invention is a viable article of manufacture, with realistic cost expenditures associated with its production.

Figure 6:
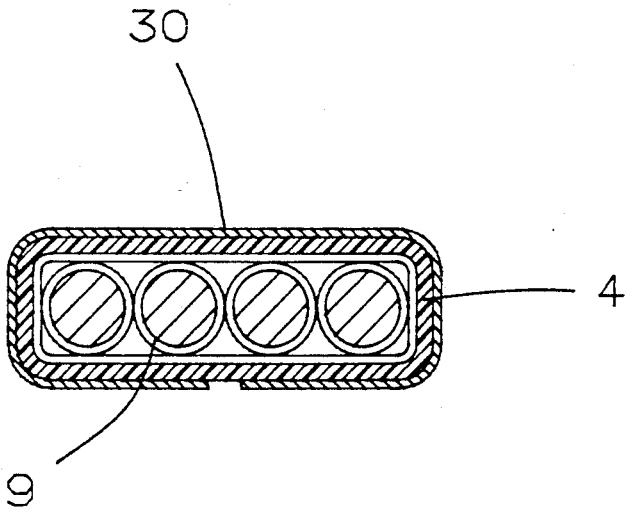
FIG. 6 is an enlarged cross-sectional view showing the rear end of the four cable wires in a rectangular shaped radio jack strain relief and identification holder taken along line 6—6 of FIG. 1.
Figure 7:
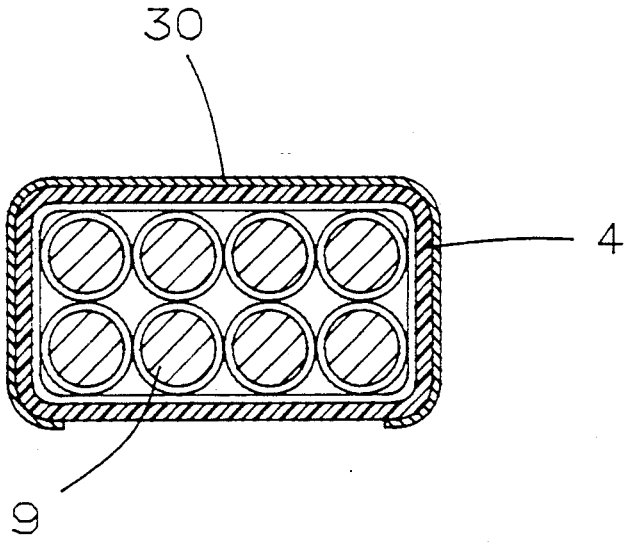
FIG. 7 is an enlarged cross-sectional view showing the rear end of an eight cable wires in a rectangular shaped radio jack strain relief and identification holder.
Figure 9:
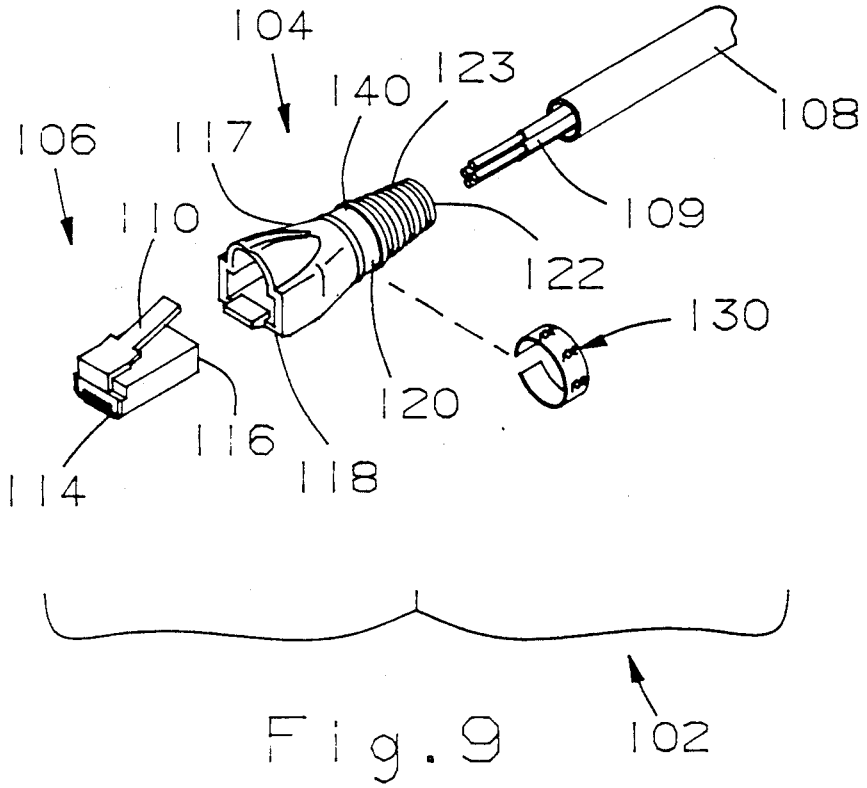
FIG. 9 is an exploded view of the present invention radio jack strain relief and identification holder shown in FIG. 8.
Figure 10:
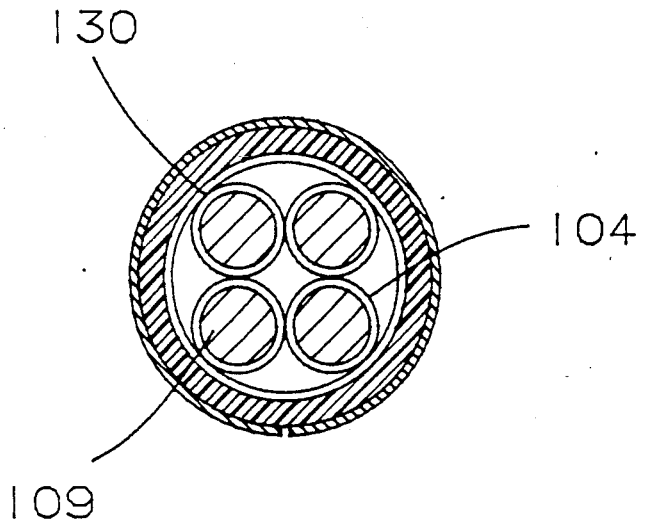
FIG. 10 is an enlarged cross-sectional view showing the rear end of the four cable wires in a circular shaped radio jack strain relief and identification holder taken along line 10—10 of FIG. 8.
Figure 11:
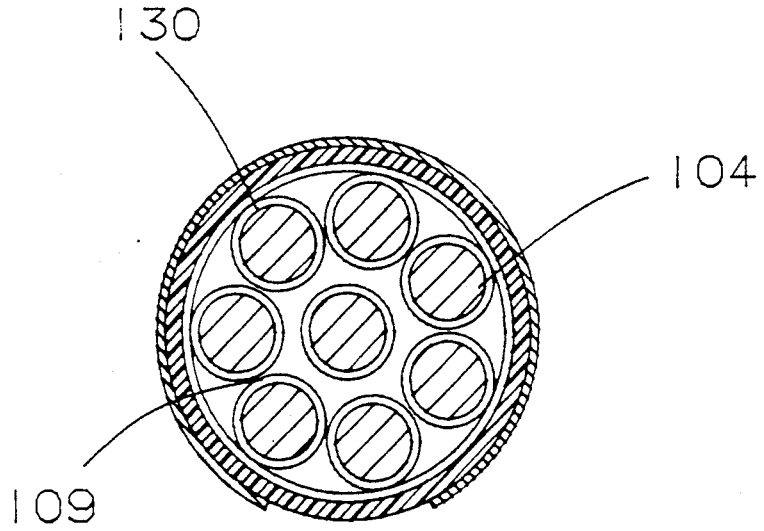
FIG. 11 is an enlarged cross-sectional view showing the rear end of an eight cable wires in a circular shaped radio jack strain relief and identification holder.

Referring again to FIG. 2, there is shown a C-shaped ring 30 which can be crimped or attached to the middle section 20 of the strain relief and identification holder 4 and is utilized for identifying the radio jack 6. The C-shaped ring 30 can be conformed to any shape or size of the cable, as shown in FIGS. 6, 7, 10 and I 1. By stenciling the C-shaped ring 30 with identifying indicia such as numbers or letters, as illustrated in FIG. 2, one can identify what is connected to what. By way of example, the C shaped ring 30 can be arbitrarily marked as 301, as shown in FIGS. 2 and 9, It is appreciated that the example given above is not limited to the three identifying indicia markings as shown in the drawings; it is within the spirit and scope of the present invention to have a multiplicity of identifying indicia markings on the C-shaped ring 30. The concept is to have a strain relief and identification holder at both ends of the cable 8 with corresponding identifying indicia marked onto the surface of the C-shaped ring 30. This method makes cable identifying and troubleshooting a simple and effortless task when cables and the system are installed and also when the system is repaired. The C-shaped ring 30 is preferably made of clad metal material in which the exterior surface can be stenciled. It is appreciated that the C-shaped ring 30 is not limited to the clad metal material. Any suitable metal will be sufficient as long as stenciling can be preformed on the metal surface. Another way of identifying the radio jack 6 is to have the rings 30 color coded. By having a multiplicity of colored rings, one can simply match the colors of the colored ring 30 to the color of the cable or outlet, and thereby make troubleshooting and identifying a simpler task. The ring 30 can also be configured to conform to the shape of the cable - for example rectangular for flat cables, as illustrated in FIGS. 6 and 7 or a circular ring 130 for round cables, as illustrated in FIGS. 10 and 11.

The location 40 on the middle section 20 where the ring 30 is placed has a diameter "D" which depends on the cable size and shape, so that the rings 30 can conform to the diameter and be easily interchangeable. The ring 30 will be fully closed for the 2, 4 or 6 conductors and partially opened for the 8 conductors. FIG. 6 shows an enlarged cross-sectional view of a rectangular shaped ring 30 fully enclosing the 4 conductors. Similarly, FIG. 7 shows an enlarged cross-sectional view of a rectangular shaped ring 30 partially enclosing the 8 conductors. In addition, the location 40 is depressed as shown in FIG. 4, so that apparatus retaining members 42 and 44 can function to hold the identification ring in place after it is placed into depressed diameter location 40. Through this identification method, the identification rings are firmly held in place but at the same time, are removable and interchangeable.

In operation, when assembling the radio jack 6 to the strain relief and identification holder 4, the reduced inner cross-sectional dimensions 34 of the strain relief and identification holder 4 is adapted to fit the diameter and shape of the cable 8 by cutting off the rear end portions at an appropriate inner cross-sectional dimension 34, and the radio jack 4 can be identified by the ring 30. By being made of flexible and elastic material, the strain relief can stretch to fit around round or rectangular cable.

Figure 8:
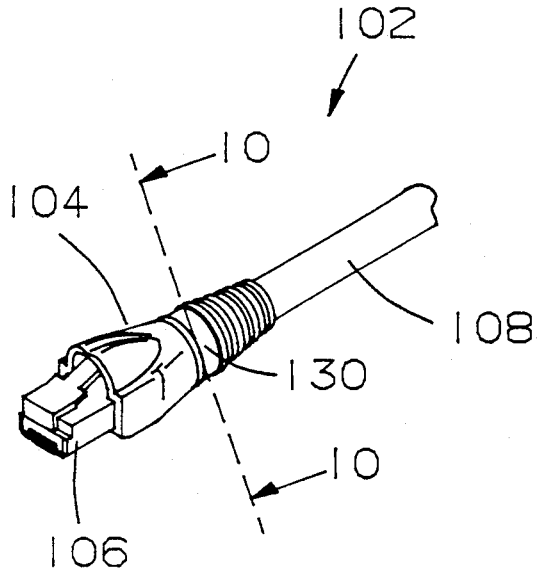
FIG. 8 is a perspective view of the present invention radio jack strain relief and identification holder connected to a round cable.

Referring to FIGS. 8 and 9, there is shown at 102 the present invention radio jack strain relief and identification holder utilized with a round cable 108. Since it assembles and functions the same as previously described above except that the round cable 108 is substituted for the flat cable 8 shown in FIGS. 1 and 2, the parts are numbered correspondingly with 100 added to each number. Of course, the cross section of rear section 123 is round as shown in FIGS. 10 and I 1, instead of rectangular as in rear 23, shown in FIGS. 6 and 7. The location diameter 140 and ring 130 remain the same.

The present invention has many advantageous features including: (a) a simple method of identifying the radio jack; (b) the strain relief and identification holder has reduced inner cross-sectional dimensions which can accommodate many different cable diameters; and (c) it is inexpensive to manufacture.

Defined in detail, the present invention is an apparatus for a conventional radio jack having a top index lock pin and a bottom recess notch, and the radio jack connected to a cable with wires, the apparatus comprising: (a) a strain relief and identification holder having an elongated flexible body with a front end, a middle section and a rear section with a rear end, the elongated flexible body having a hollow interior chamber extending therethrough from a wide opening at the front end to a narrow opening at the rear end, where the front end receives and partially encloses said radio jack; (b) a flexible dust cover integrally molded to said elongated flexible body at a location adjacent to said front end for partially covering said top index lock pin of said radio jack; (c) said front end of said elongated flexible body having a protruding tongue extending inwardly into said chamber at the location of said wide opening and at a location opposite to said flexible dust cover for engagement with said bottom recess notch on said radio jack to prevent said radio jack from longitudinal movement within said elongated flexible body of said strain relief and identification holder; (d) said narrow opening at said rear end forming a longitudinal internal cable entrance with reduced inner cross-sectional dimensions for tightly retaining said cable such that the reduced inner cross-sectional dimensions engage against opposite sides of said cable for relieving any strain transmitted on said cable, and spread the strain over an extended length of said cable; (e) said middle section having a reduced diameter portion for receiving a C-shaped ring crimped onto said middle section of said elongated flexible body and having identifying indicia thereon for identifying said radio jack.

Defined broadly, the present invention is an apparatus for a conventional radio jack having a locking pin and a recess notch, and the radio jack connected to a cable with wires, the apparatus comprising: (a) a flexible strain relief and identification holder having a front end, a rear end and a hollow chamber extending therethrough from an opening at the front end to an opposite opening at the rear end, where the opening at the front end receives and partially encloses said radio jack, and the opening at the rear end forms a longitudinal cable entrance with reduced inner cross-sectional dimensions for tightly engaging said cable to relieve any strain transmitted on said cable, and spread the strain over an extended length of said cable; (b) a flexible dust cover integrally molded to said strain relief and identification holder at a location adjacent to said front end for partially covering said locking pin of said radio jack; (c) said flexible strain relief and identification holder having a protruding tongue extending into said opening at said front end for engagement with said recess notch on said radio jack to prevent said radio jack from longitudinal movement; and (d) a ring means attached to said strain relief and identification holder and having identifying indicia thereon for identifying said radio jack.

Defined more broadly, the present invention is an apparatus for a conventional radio jack connected to a cable, comprising: (a) a strain relief and identification holder having a hollow body with a first end with an opening for receiving and partially enclosing said radio jack and a second end with a cable entrance which has reduced inner cross-sectional dimensions for tightly retaining said cable; and (b) means for identifying said radio jack.

Defined alternatively, the present invention is a method of identifying and providing strain relief for a conventional radio jack that has a top index lock pin and a bottom recess notch, and the radio jack connected to a cable with wires, the method comprising the steps of: (a) providing a strain relief and identification holder having an elongated flexible body with a front end, a middle section and a rear section with a rear end, the elongated flexible body having a hollow interior chamber extending therethrough from a wide opening at the front end to a narrow opening at the rear end, where the front end receives and partially encloses said radio jack; (b) integrating a flexible dust cover to said elongated flexible body at a location adjacent to said front end for partially covering said top index lock pin of said radio jack; (c) providing said front end of said elongated flexible body with a protruding tongue extending inwardly into said chamber at the location of said wide opening and at a location opposite to said flexible dust cover for engagement with said bottom recess notch on said radio jack to prevent said radio jack from longitudinal movement within said elongated flexible body of said strain relief and identification holder; (d) forming said narrow opening at said rear end with a longitudinal internal cable entrance with reduced inner cross-sectional dimensions for tightly retaining said cable such that the reduced inner cross-sectional dimensions engage against opposite sides of said cable for relieving any strain transmitted on said cable, and spreading the strain over an extended length of said cable; (e) crimping a C-shaped ring onto said middle section of said elongated flexible body and having identifying means associated with the ring for identifying said radio jack; and (f) cutting off said excess flexible elongated body of said strain relief and identification holder prior to assembling said radio jack to said strain relief and identification holder to have said reduced inner cross-sectional dimensions adapted to fit the diameter of said cable.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated. The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An apparatus for a conventional radio jack having a top index lock pin and a bottom recess notch, and the radio jack connected to a cable with wires, the apparatus comprising:

a. a strain relief and identification holder having an elongated flexible body with a front end, a middle section and a rear section with a rear end, the elongated flexible body having a hollow interior chamber extending therethrough from a wide opening at the front end to a narrow opening at the rear end, where the front end receives and partially encloses said radio jack;

b. a flexible dust cover integrally molded to said elongated flexible body at a location adjacent to said front end for partially covering said top index lock pin of said radio jack;

c. said front end of said elongated flexible body having a protruding tongue extending inwardly into said chamber at the location of said wide opening and at a location opposite to said flexible dust cover for engagement with said bottom recess notch on said radio jack to prevent said radio jack from longitudinal movement within said elongated flexible body of said strain relief and identification holder;

d. said narrow opening at said rear end forming a longitudinal internal cable entrance with reduced inner cross-sectional dimensions for tightly retaining said cable such that the reduced inner cross-sectional dimensions engage against opposite sides of said cable for relieving any strain transmitted on said cable, and spread the strain over an extended length of said cable; and e. said middle section having a reduced diameter portion for receiving a C-shaped ring crimped onto said middle section of said elongated flexible body and having identifying indicia thereon for identifying said radio jack.

2. The invention as defined in claim 1 further comprising opposite retaining members located on opposite sides of said reduced diameter middle portion to removably retain said C-shaped ring onto said middle section.

3. The invention as defined in claim 1 wherein said elongated flexible body of said strain relief and identification holder is made of semi-rubber material.

4. The invention as defined in claim 1 wherein said strain relief and identification holder with said reduced inner cross-sectional dimensions can accommodate a round cable.

5. The invention as defined in claim 1 wherein said strain relief and identification holder with said reduced inner cross-sectional dimensions can accommodate a flat cable.

6. The invention as defined in claim 1 wherein said rear section has a multiplicity of different sized cross-sections along its length so that the rear section can be cut at any of its various cross-sections to specifically accommodate the size of a given cable.

7. The invention as defined in claim 1 wherein said C-shaped ring is color coded.

8. An apparatus for a conventional radio jack having a locking pin and a recess notch, and the radio jack connected to a cable with wires, the apparatus comprising:

a. a flexible strain relief and identification holder having a front end, a rear end and a hollow chamber extending therethrough from an opening at the front end to an opposite opening at the rear end, where the opening at the front end receives and partially encloses said radio jack, and the opening at the rear end forms a longitudinal cable entrance with reduced inner cross-sectional dimensions for tightly engaging said cable to relieve any strain transmitted on said cable, and spread the strain over an extended length of said cable;

b. a flexible dust cover integrally molded to said strain relief and identification holder at a location adjacent to said front end for partially covering said locking pin of said radio jack;

c. said flexible strain relief and identification holder having a protruding tongue extending into said opening at said front end for engagement with said recess notch on said radio jack to prevent said radio jack from longitudinal movement; and d. a ring means attached to said strain relief and identification holder and having identifying indicia thereon for identifying said radio jack.

9. The invention as defined in claim 8 wherein said flexible strain relief and identification holder is made of semi-rubber material.

10. The invention as defined in claim 8 further comprising a middle portion between said front end and said rear end, the middle portion having a reduced diameter for receiving a ring means.

11. The invention as defined in claim 10 further comprising opposite retaining members located on opposite sides of said reduced diameter middle portion to removably retain said ring onto the middle portion.

12. The invention as defined in claim 8 further comprising a rear section terminating in said rear end, the rear section having a multiplicity of different sized cross-sections along its length so that the rear section can be cut along any of its various cross-sections to specifically accommodate the size of a given cable.

13. The invention as defined in claim 8 wherein said flexible strain relief and identification holder with said reduced inner cross-sectional dimensions can accommodate a round cable.

14. The invention as defined in claim 8 wherein said flexible strain relief and identification holder with said reduced inner cross-sectional dimensions can accommodate a flat cable.

15. The invention as defined in claim 8 wherein said ring means is a C-shaped ring.

16. The invention as defined in claim 8 wherein said ring means is rectangular shaped.

17. The invention as defined in claim 8 wherein said identification indicia on said ring means is to have the ring means color coded.

18. The invention as defined in claim 8 wherein said identification indicia on said ring means are numbers and letters.

19. An apparatus for a conventional radio jack connected to a cable, comprising:

a. a strain relief and identification holder having a hollow body with a first end with an opening for receiving and partially enclosing said radio jack and a second end with a cable entrance which has reduced inner cross-sectional dimensions for tightly retaining said cable;

b. a cover integrally molded to said hollow body of said strain relief and identification holder for partially covering said radio jack; and c. means for identifying said radio jack.

20. The invention as defined in claim 19 further comprising a protruding tongue extending into said opening of said first end for engagement with a recess notch of said radio jack.

21. The invention as defined in claim 19 wherein said strain relief and identification holder is made of semi-rubber material.

22. The invention as defined in claim 19 wherein said strain relief and identification holder with said reduced inner cross-sectional dimensions can accommodate a round cable.

23. The invention as defined in claim 19 wherein said strain relief and identification holder with said reduced inner cross-sectional dimensions can accommodate a flat cable.

24. A method of identifying and providing strain relief for a conventional radio jack that has a top index lock pin and a bottom recess notch, and the radio jack connected to a cable with wires, the method comprising the steps of:

a. providing a strain relief and identification holder having an elongated flexible body with a front end, a middle section and a rear section with a rear end, the elongated flexible body having a hollow interior chamber extending therethrough from a wide opening at the front end to a narrow opening at the rear end, where the front end receives and partially encloses said radio jack;

b. integrating a flexible dust cover to said elongated flexible body at a location adjacent to said front end for partially covering said top index lock pin of said radio jack;

c. providing said front end of said elongated flexible body with a protruding tongue extending inwardly into said chamber at the location of said wide opening and at a location opposite to said flexible dust cover for engagement with said bottom recess notch on said radio jack to prevent said radio jack from longitudinal movement within said elongated flexible body of said strain relief and identification holder;

d. forming said narrow opening at said rear end with a longitudinal internal cable entrance with reduced inner cross-sectional dimensions for tightly retaining said cable such that the reduced inner cross-sectional dimensions engage against opposite sides of said cable for relieving any strain transmitted on said cable, and spreading the strain over an extended length of said cable;

e. crimping a C-shaped ring onto said middle section of said elongated flexible body and having identifying means associated with the ring for identifying said radio jack; and f. cutting off said excess flexible elongated body of said strain relief and identification holder prior to assembling said radio jack to said strain relief and identification holder to have said reduced inner cross-sectional dimensions adapted to fit the diameter of said cable.

25. An apparatus for a conventional radio jack connected to a cable, comprising:

a. a strain relief and identification holder having a hollow body with a first end with an opening for receiving and partially enclosing said radio jack and a second end with a cable entrance which has reduced inner cross-sectional dimensions for tightly retaining said cable; and b. means for identifying said radio jack, including a ring crimped onto said strain relief and having identifying indicia on said ring.

26. The invention as defined in claim 25 further comprising a protruding tongue extending into said opening of said first end for engagement with a recess notch of said radio jack.

27. The invention as defined in claim 25 wherein said strain relief and identification holder is made of semi-rubber material.

28. The invention as defined in claim 25 wherein said strain relief and identification holder with said reduced inner cross-sectional dimensions can accommodate a round cable.

29. The invention as defined in claim 25 wherein said strain relief and identification holder with said reduced inner cross-sectional dimensions can accommodate a flat cable.

* * * * *